US007452243B2

(12) United States Patent
Wan et al.

(10) Patent No.: US 7,452,243 B2
(45) Date of Patent: Nov. 18, 2008

(54) ELECTRICAL CONNECTOR WITH CONTACT MODULES AND METHOD FOR MAKING THE SAME

(75) Inventors: Feng Wan, Kunshan (CN); Jin-Kui Hu, Kunshan (CN); Guo-Hua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/801,318

(22) Filed: May 9, 2007

(65) Prior Publication Data

US 2007/0264876 A1 Nov. 15, 2007

(30) Foreign Application Priority Data

May 12, 2006 (CN) ..... 2006 1 0040423

(51) Int. Cl.
*H01R 24/00* (2006.01)

(52) U.S. Cl. ..... 439/637

(58) Field of Classification Search ..... 439/630, 439/637, 607, 701, 719, 320
See application file for complete search history.

(56) References Cited

U.S. PATENT DOCUMENTS

| | | | | |
|---|---|---|---|---|
| 6,582,255 | B2 * | 6/2003 | Simmons et al. | 439/701 |
| 6,685,486 | B1 | 2/2004 | Zhang et al. | |
| 6,755,691 | B2 * | 6/2004 | Sasame et al. | 439/607 |
| 6,863,569 | B2 * | 3/2005 | Zhu et al. | 439/607 |
| 6,890,220 | B2 | 5/2005 | Wang | |
| 6,899,548 | B2 * | 5/2005 | Houtz | 439/71 |
| 6,923,662 | B2 * | 8/2005 | Sasame et al. | 439/79 |

* cited by examiner

*Primary Examiner*—Alexander Gilman
(74) *Attorney, Agent, or Firm*—Wei Te Chung

(57) ABSTRACT

An electrical connector includes an insulative housing and a plurality of contact modules received in the insulative housing. The contact module comprises a plurality of electrical contacts, and a plurality of first and second inserts. Each electrical contact has a mating portion and a mounting portion. The mating portions and mounting portions are arranged in a plurality of rows respectively. Each first insert is formed on one row of the mating portions and each second insert is formed on one row of the mounting portions.

20 Claims, 7 Drawing Sheets

ELECTRICAL CONNECTOR WITH CONTACT MODULES AND METHOD FOR MAKING THE SAME

BACKGROUND OF THE INVENTION

1. Field of the Invention

The present invention relates to an electrical connector, and particularly to an electrical connector with contact modules.

2. Description of Related Art

U.S. Pat. No. 6,890,220 discloses a receptacle connector having an insulative body, a plurality of rows electrical contacts inserted therein, and a spacer mounted on the insulative housing for retaining solder tails of the contacts. True positions of the electrical contacts are ensured by the spacer and the fits between the contacts and the insulative housing. Nowadays, more and more electrical connectors have standard mating ports for engaging with standard plugs manufacturing by different companies. Sometimes, there is a need to increase the overall lengthwise dimension of the electrical connector due to the requirements of the environment where the electrical connector mounted on. Since the dimension of the electrical contacts increased, the true positions of the electrical contacts will be inaccurate if only depend the spacer and the fits of the electrical contacts and the insulative housing.

A Digital Visual Interface (DVI) connector as disclosed in U.S. Pat. No. 6,685,486 comprises an insulative housing, a plurality of contact modules fixed to the insulative housing in a mating direction thereof, and a spacer for aligning contacts of the contact modules and facilitating the connector mounting to a printed circuit board. Each contact has a mating end for corresponding to a plug, a connect section molding with an insulative block, and a solder tail for mounting on the printed circuit board. The contact modules can provide the true positions of the mating ends of the electrical contacts for the connector section being inserted molded with the block. If the lengths of the electrical contacts are increased, the true positions of the solder tails will not be ensured for the increased parts thereof being easy to distort.

Hence, an improved electrical connector is required to overcome the disadvantages of the prior art.

BRIEF SUMMARY OF THE INVENTION

Accordingly, an object of the present invention is to provide an electrical connector, the electrical contacts of which have improved true positions.

A further object of the present invention is to provide a method for making an electrical connector having contact modules.

According to one embodiment of the present invention, an electrical connector includes an insulative housing and a plurality of contact modules attached to the insulative housing. The contact module comprises a plurality of electrical contacts, and a plurality of first and second inserts. Each electrical contact has a mating portion and a mounting portion. The mating portions and mounting portions are arranged in a plurality of rows respectively. Each first insert is formed on one row of the mating portions and each second insert is formed on one row of the mounting portions. The first inserts are formed on the electrical contacts through a first insert molding and the second inserts are formed on the electrical contacts through a second insert molding.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
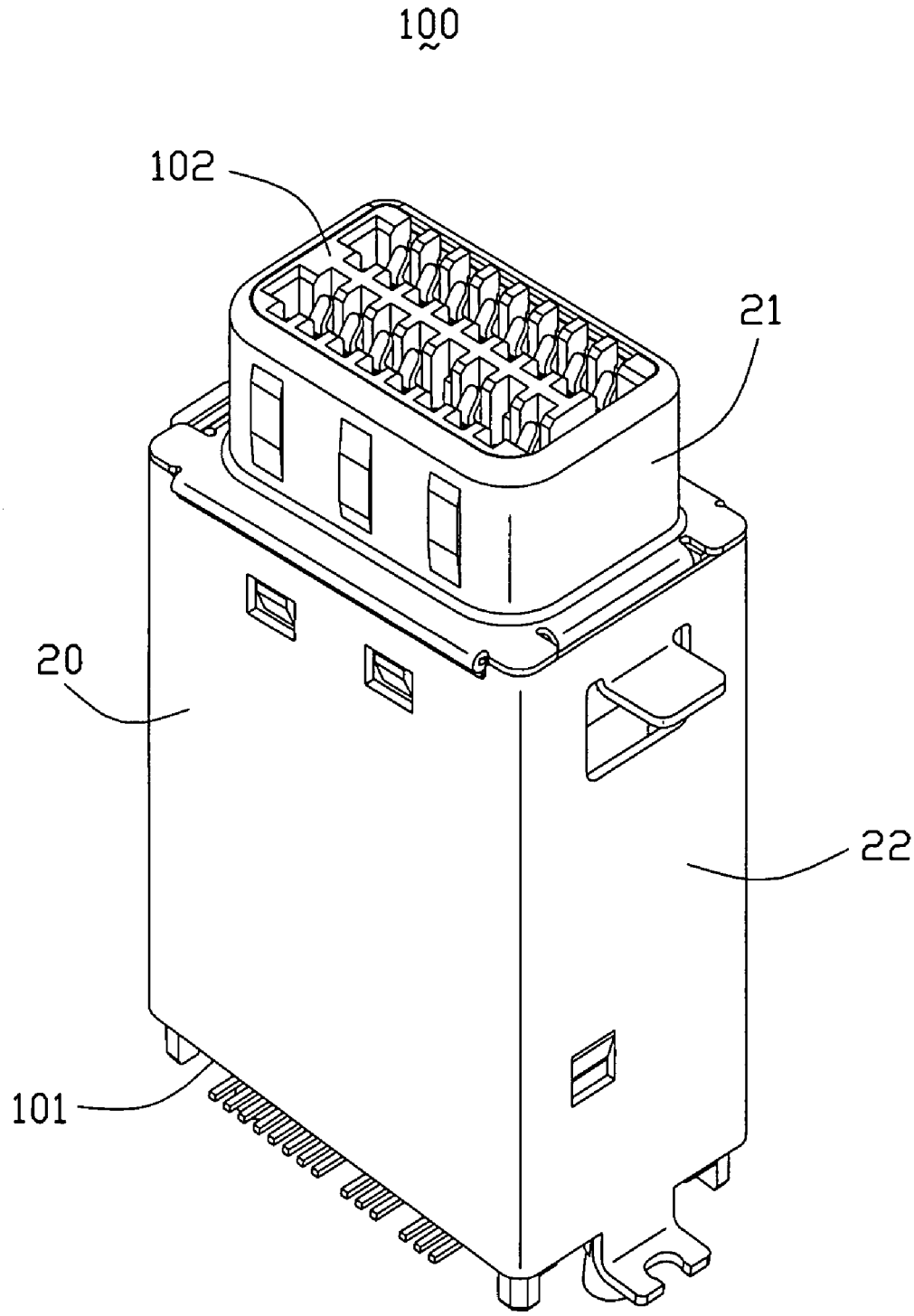
FIG. 1 is a perspective view of an electrical connector in accordance with the present invention.
Figure 2:
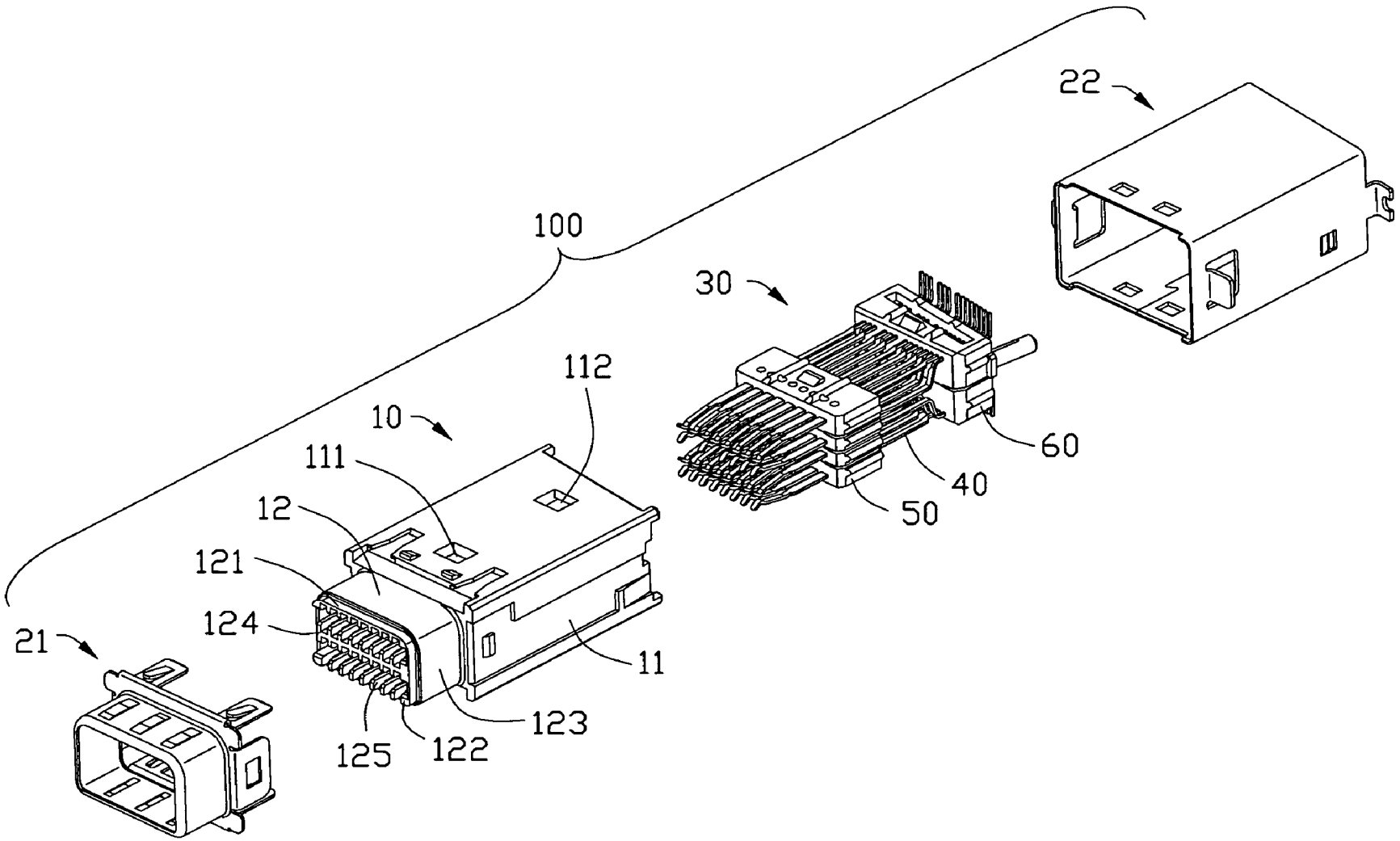
FIG. 2 is an exploded view of the electrical connector shown in FIG. 1.
Figure 3:
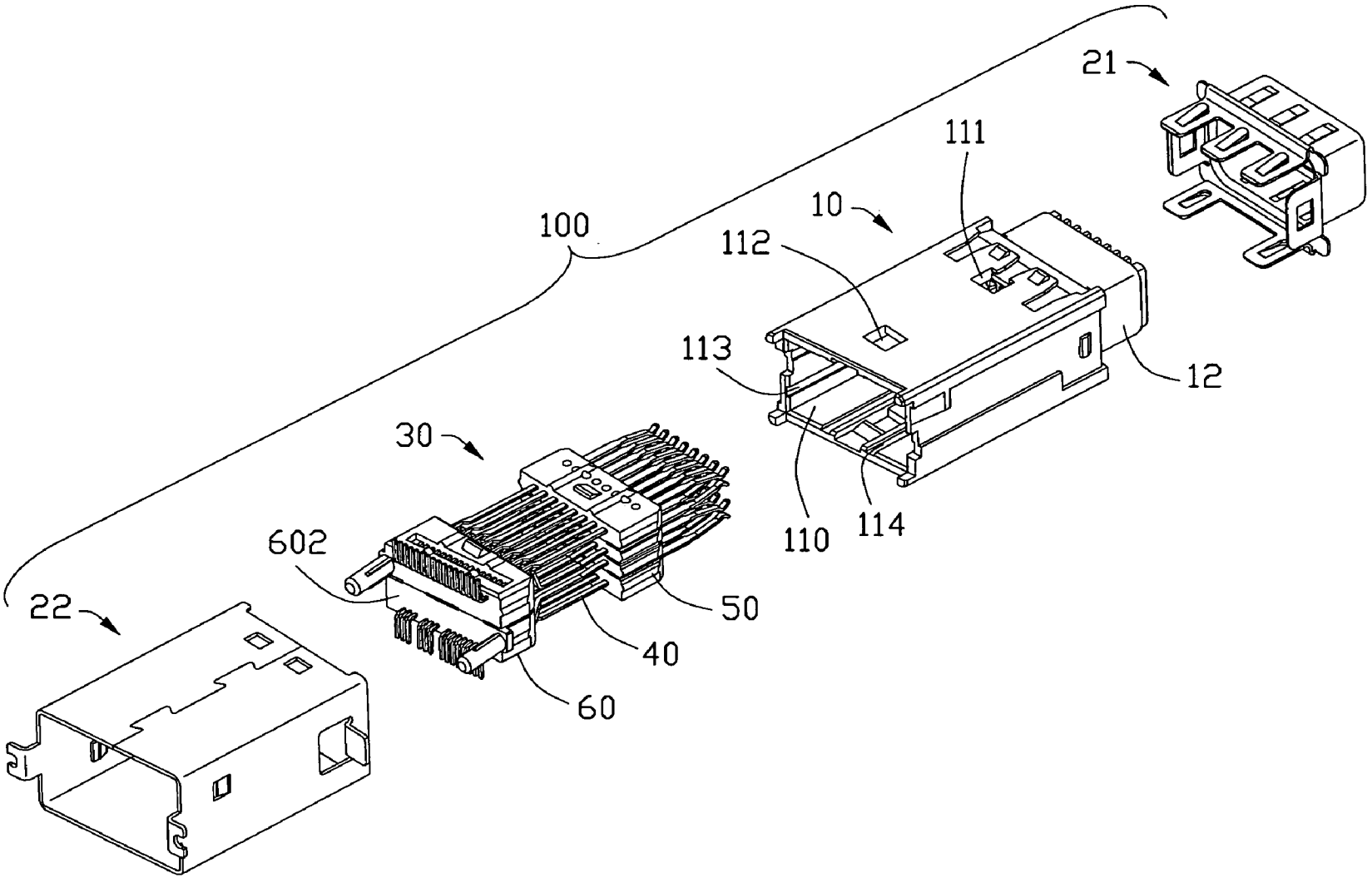
FIG. 3 is another exploded view of the electrical connector shown in FIG. 1, while taken from a different aspect.

Referring to FIGS. 1 to 3, an electrical connector 100 in accordance with the present invention for mounting to a printed circuit board (not shown) includes an insulative housing 10, a plurality of contact modules 30 inserted into the insulative housing 10, and a shield means 20 enclosed the insulative housing 10. The electrical connector 100 is straight and defines a mounting face 101 parallel to a top face of the printed circuit board and a mating face 102 opposite to the mounting face 101. The mating face 102 is at an oblique angle to the mounting face 101.

The insulative housing 10 is a one-piece structure unitarily molded of dielectric material such as plastic or the like. The shield means 20 is a two-piece structure which includes a first shell 21 and a second shell 22. The insulative housing 10 has a base portion 11 and a rectangular mating port 12 extending upwardly from the base portion 11 for mating with a complementary plug (not shown) in an up to down direction. The base portion 11 defines a downwardly facing longitudinal cavity 110 for receiving the plurality of contact modules 30 therein. The mating port 12 of the insulative housing 10 has a front wall 121, a back wall 122 parallel to the front wall 121, and a pair of sidewalls 123 connected the front and the back wall 121, 122. The mating port 12 includes a tongue plate 124 paralleled to the front and back wall 121, 122 and extending therebetween.

Figure 4:
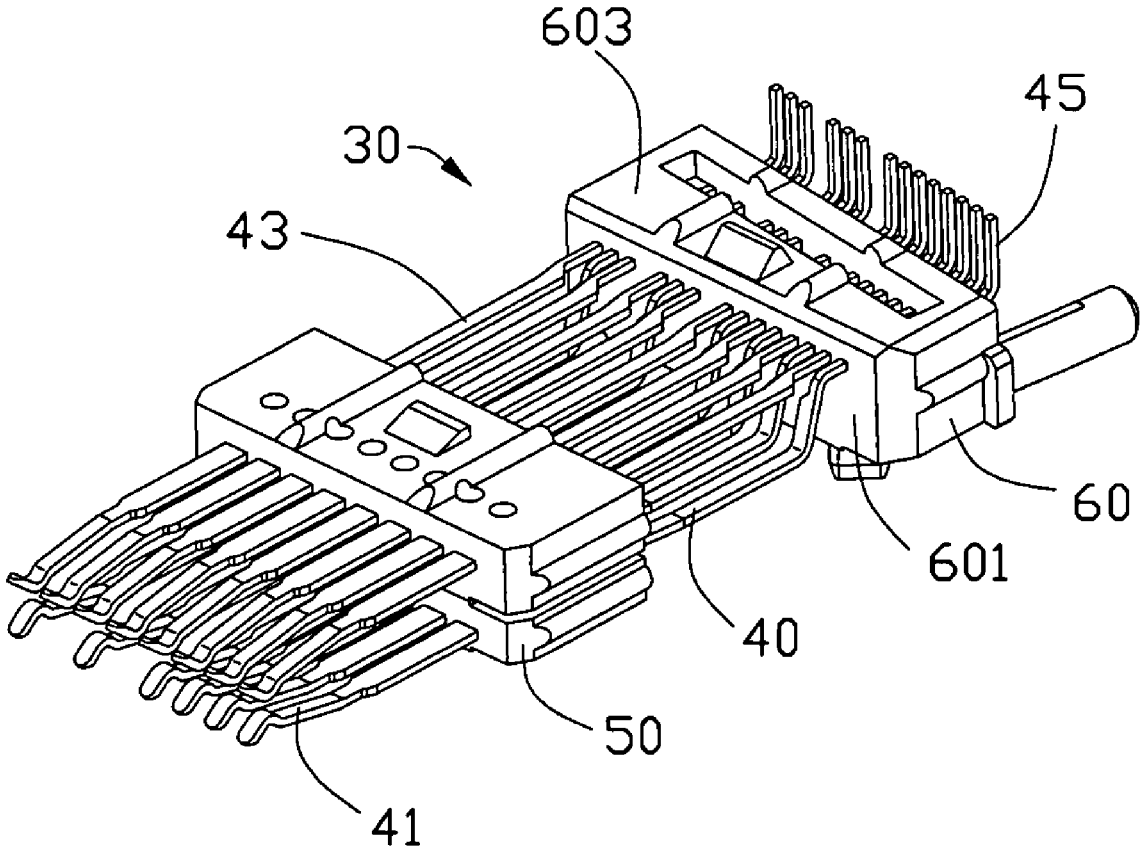
FIG. 4 is a perspective view of a contact module of the electrical connector.
Figure 5:
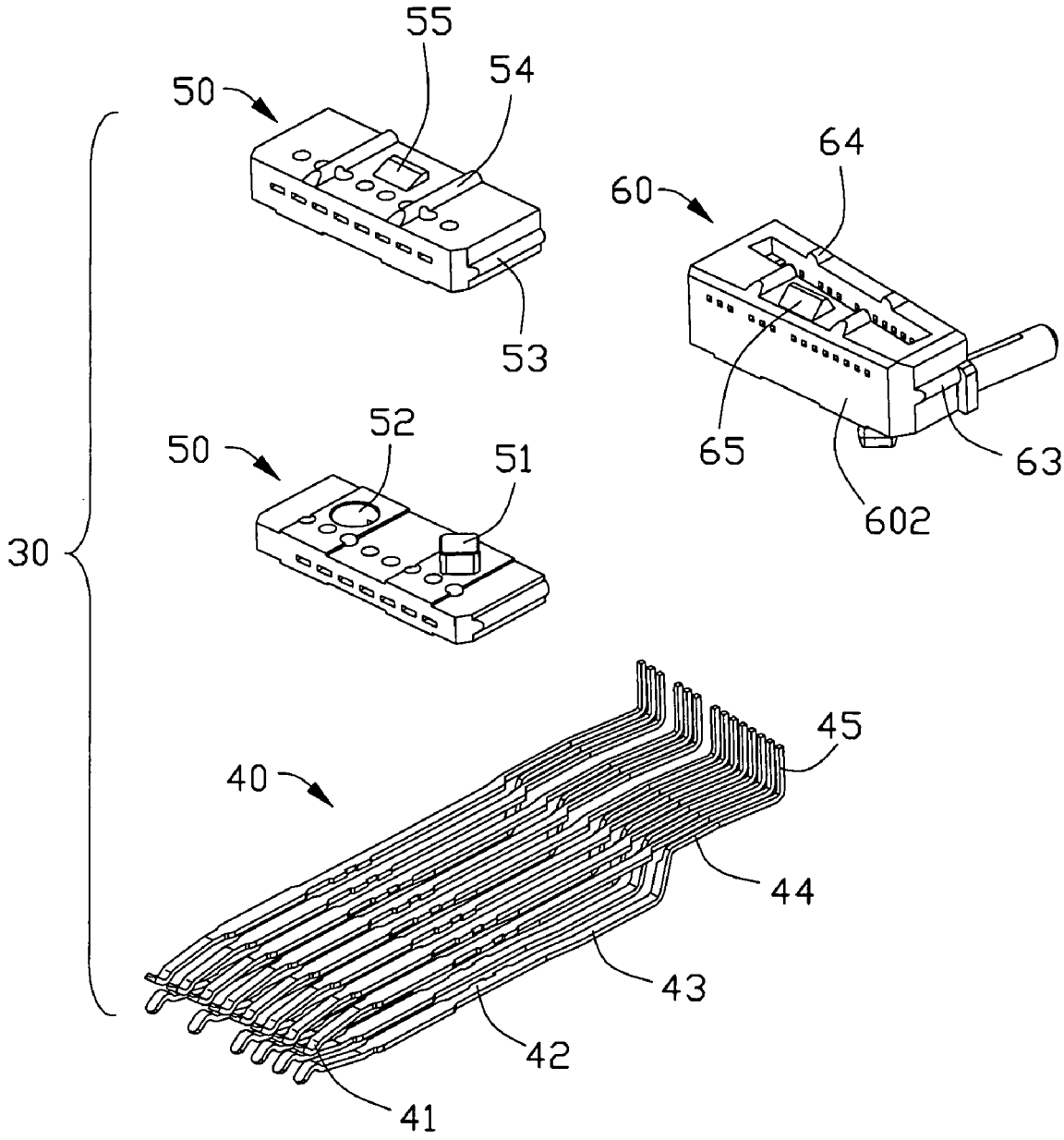
FIG. 5 is an exploded view of the contact module shown in FIG. 4.
Figure 6:
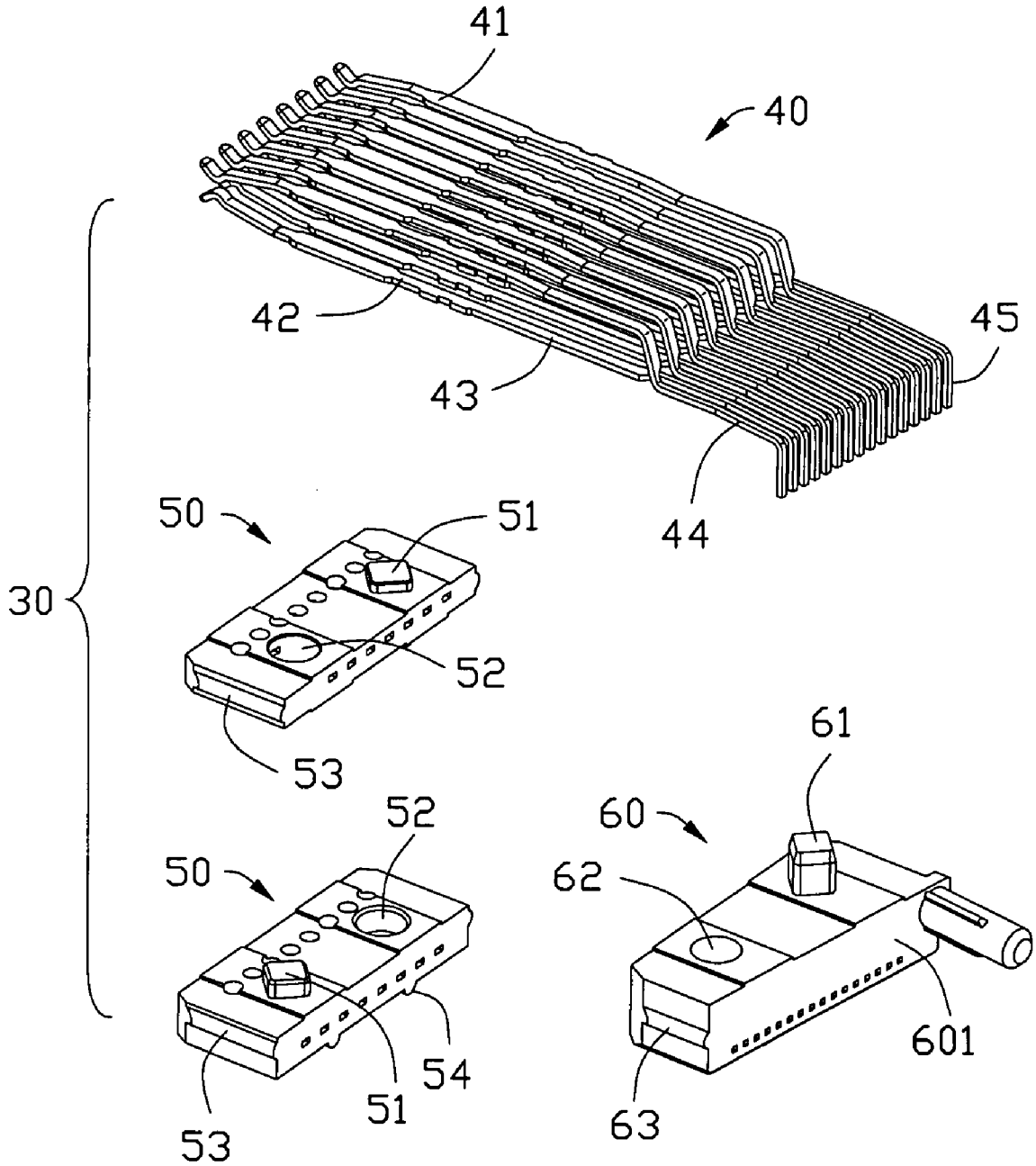
FIG. 6 is a view similar to FIG. 5, while viewed from another aspect.

Now, the detailed structure of the contact modules 30 will be described. Referring to FIGS. 4-6, each contact module 30 includes a plurality of vertical electrical contacts 40, two rectangular first inserts 50, and a second insert 60 formed on the electrical contacts 40 respectively. The first inserts 50 and the second insert 60 are insert molded to body sections of the electrical contacts 40. Each electrical contact 40 includes a mating end 41 and a solder tail 45 extending from the opposite sides of the body section. A plurality of passageways 125 are defined on the front wall 121, the back wall 122, and the tongue plate 124 of the mating port 12 for receiving the mating ends 41 therein. The second insert 60 defines a bottom face 601 parallel to the mounting face 101 of the electrical connector 100 and a top face 602 parallel to the mating face 102.

The body section of each electrical contact 30 includes a first fixed section 42 connected with the mating end 41, a second fixed section 44 connected with the solder tail 45, and a middle section 43 extending therebetween. Each contact module 30 includes two types of electrical contacts 40 and the electrical contacts 40 of the same type are arranged in one row. One type of the electrical contacts is straight and the other type is bent at the intersection of the middle section 43 and the second fixed section 44.

Furthermore, in each contact module 30, the electrical contacts 40 are arranged in different rows at mating portions and mounting portions. The mating portions of the electrical contacts 40 each including the mating end 41 and the first fixed section 42 are arranged in two rows. Each row of the mating portions forms one first inserts 50 thereon. The mounting portions of the electrical contacts 40 each including the solder tail 45 and the second fixed section 44 are arranged in one row with the second insert 60 formed thereon. The first inserts 50 are insert molded to the first fixed sections 42 and the second insert 60 is formed on the second fixed section 44. The solder tails 45 are SMT (Surface Mounted Technology) type. The mounting portions extending within the second insert 60 or the second fixed sections 44 have different lengths respectively and deflect to one side face 603 of the second insert 60.

The electrical connector 100 includes first latch means for respectively latching the first inserts 50 thereof in a first side-by-side array and the second inserts 60 thereof in a second side-by-side array. The first side-by-side array and the second side-by-side array are disposed along the up to down direction of the electrical connector 100. The first latch means includes a first and second latch projection 51, 61 and a first and second recess 52, 62 formed on the adjacent sides of two inserts. The first latch projection 51, 61 and recess 52, 62 are defined on one of the adjacent sides. The second recess 52, 62 and latch projection 51, 61 are defined on the other of the adjacent sides and corresponding to the first latch projection 51, 61 and recess 52, 62.

The electrical connector has second latch means and positioning means for assembling the insulative housing 10 and the contact modules 30. The second latch means includes third latch projections 55, 65 on the outermost inserts and third recesses 111, 112 on the base portion 11 of the insulative housing 10. The third latch projections 55, 65 are engaged with the third recesses 111, 112 respectively. Generally, the positioning means such as ribs 53, 54, 63, 64 are provided on each opposite side faces of the inserts 40, 50 engageable with the complementary positioning means such as grooves 113, 114 at each opposite sidewalls of the base portion 11. The ribs 53, 54, 63, 64 are dimensioned for sliding into the grooves 113, 114 to properly position the contact modules 30 therein.

The method of manufacturing each contact module will be described in detail. First, provide a plurality of electrical contacts 40 each having a mating portion and a mounting portion. Second, arrange the mating portions of the electrical contacts 40 in two rows. Third, insert mold the first insert on each row of the mating portions to generate two sub-contact modules. Then, arrange the mounting portions of the tow sub-contact module in one row. The two sub-contact modules are engageable by the first means. Finally, form the second insert on the row of the mounting portions through a second insert molding procedure. More particularly, each insert and the latching means and the positioning means thereon are molded integrally.

In assembling the electrical connector 100, the plurality of contact modules 30 are interengagable by the first latch means. The plurality or "cluster" of contact modules 30 are inserted into the insulative housing 10 as a whole. The ribs 53, 54, 63, 64 of the inserts guide the insertion of the contact modules 30 and are received in the grooves 113, 114. The third latch projections 55, 65 of the outermost inserts are engaged with the third recesses 111, 112 of the insulative housing 10. The mating ends 41 of the electrical contacts 40 are located in the passageways 125 of the mating port 12, and the solder tails 45 thereof project out of the mounting face 101.

The first inserts 50 and the second inert 60 are formed at two opposite portions of the electrical contacts 40 through twice insert molding procedures to establish electrical connections with the mating plug and the printed circuit board respectively. The first inserts 50 and the second inserts 60 ensure the true positions of the electrical contacts 40 at two ends respectively. Additionally, the second inert 60 also improve the flatness of the solder tails 45 for surface mounting to the printed circuit board.

Figure 7:
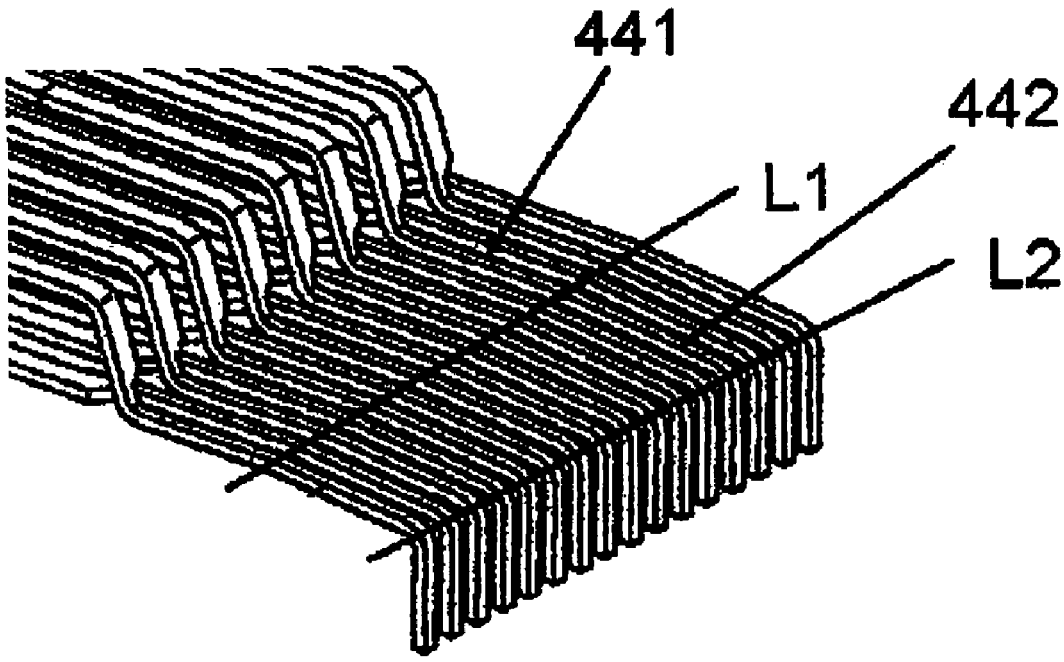
FIG. 7 is an enlarged view of a portion of the contacts taken from FIG. 6 and showing the deflection lines formed on the fixed sections of the contacts.

FIG. 7 shows a first deflection line L1 formed in the middle portions of the second fixed sections 44, and a second deflection line L2 formed at joints between the second fixed sections 44 and the solder tails 45, so that the whole second fixed sections divided by the first deflection line L1 to form a front region 441 and a rear region 442 thereof. It is noted tat an extension pf the rear region 442 is not aligned with an extension of the front region 441 in the front-to-back direction while being oblique thereto under a condition tat the extension of the rear region 442 is essentially perpendicular to the first deflection line L1. It is also noted that the second deflection line L2 is perpendicular to both the extension of the rear regions 442 and the solder tails 45 while being oblique to the first deflection line L1. It is noted that the second insert 60 defines a front edge paralleled to a front end line farmed by the front regions of the fixed sections, and a rear edge oblique to the front edge the front edge.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing; and a plurality of contact modules attached to the insulative housing, each contact module comprising a plurality electrical contacts having a mating portion and a mounting portion, the mating portions and the mounting portions of the electrical contacts being arranged in a plurality of rows, wherein on each row of the mating portions forms a first insert and on each row of the mounting portions forms a second insert, and wherein the first inserts are equal in number to the rows of the mating portions and the second inserts are equal in number to the rows of the mounting portions.

2. The electrical connector as claimed in claim 1, further comprising a first latch means on said first inserts and second inserts for latching the first inserts and the second inserts in a side-by-side array respectively, and second latch means on the outermost inserts and the insulative housing for latching the contact modules and the insulative housing.

3. The electrical connector as claimed in claim 1, wherein the insulative housing comprises a base portion and a mating port extending from the base portion, and wherein the base portion defines a longitudinal cavity for receiving the contact modules.

4. The electrical connector as claimed in claim 3, wherein the mating port of the insulative housing comprises a first wall, a second wall parallel to the first wall, and a tongue plate extending therebetween, a plurality of passageways defined on the first wall, the second wall and the tongue plate to provide the mating portions of the electrical contacts extending therein.

5. The electrical connector as claimed in claim 1, wherein the mating portion of each electrical contact comprises a mating end for coupling to a complementary connector and the mounting portion of each electrical contact comprises a solder tail for mounting to a printed circuit board.

6. The electrical connector as claimed in claim 1, wherein the insulalive housing has a mounting face and a mating face oblique to the mounting face.

7. The electrical connector as claimed in claim 1, wherein the second insert defines a top face and a bottom face oblique to the top face.

8. The electrical connector as claimed in claim 1, wherein the second insert defines a top face and a bottom face, and the mounting portions extending within the second insert have different lengths, respectively.

9. A method for making an electrical connector, comprising the steps of:

providing an insulative housing;

providing a plurality of electrical contacts each comprising a first connect portion and a second connect portion;

arranging the first connect portions of the electrical contacts in a plurality of rows, insert molding a plurality of first inserts to each row of the first connect portions and fanning a plurality of sub-contact modules;

arranging the second connect portions of two sub-contact modules in one row;

insert mokling a second insert to each row of the second connect portions to from a contact module; and assembling the contact module to the insulative housing.

10. The method for making an electrical connector as claimed in claim 9, wherein the first inserts of the electrical connector are arranged in a first side-by-side array, and the second inserts of the electrical connector are arranged in a second side-by-side array, and wherein the first side-by-side array and the second side-by-side array are disposed along a mating direction of the electrical connector.

11. The method for making an electrical connector as claimed in claim 9, wherein the insulative housing comprises a base portion and a mating port extending from the base portion, the base portion having a cavity for receiving the contact module, the mating port defining a plurality of passageways for the electrical contact extending therein.

12. The method for making an electrical connector as claimed in claim 9, wherein one of first connect portion and the second connect portion of each electrical contact comprises a mating end for coupling to a complementary connector, and the other connect portion comprises a solder tail for mounting to a printed circuit board, and wherein the solder tails of the electrical contacts are surface mounted to the printed circuit board.

13. The method for making an electrical connector as claimed in claim 9, further defining a mounting face and a mating face oblique to the mounting face, and the second insert defining a bottom face parallel to the mounting face and a top thee parallel to the mating face.

14. An electrical connector comprising:

an insulative honing defining a mating port;

a plurality of contacts disposed in the housing, each of the said contacts including a mating section extending forwardly into the mating port in a first direction, and a fixed section extending rearwardly in a second direction oblique to said first direction, with a soldering tail at an end for mounting to a printed circuit board; wherein the fixed sections of said contacts define a first deflection line, at middle portions therepf so as to deflect laterally a rear region of the fixed sections in an oblique direction with regard to a front region of the fixed sections, and a second deflection line at a joined end with the soldering tails to deflect outwardly the solder tails away from the rear region of the fixed sections, the second deflection line being perpendicular to both the rear region of the fixed sections and the solder tails while being oblique to the first deflection line.

15. The electrical connector as claimed in claim 14, wherein said second deflection line is oblique to the front region of the fixed sections.

16. The electrical connector as claimed in claim 14, wherein an insert integrally encloses the fixed sections of the plurality of contacts.

17. The electrical connector as claimed in claim 16, wherein said insert defines a front edge and a rear edge oblique to the front edge.

18. The electrical connector as claimed in claim 17, the front edge is parallel to a front end line formed by the front region of the fixed sections.

19. An electrical connector for mounting to a printed circuit hoard, comprising:

a housing defining a mating face with a mating port therein;

a plurality of contacts disposed in the housing and arranged in at least one row along a row direction, each of said contacts having a front mating portion extending in the mating port along .a front-to-back direction further perpendicular to said front-to-back direction, a rear portion being essentially deflected relative to the front mating portion in the row direction and extending essentially in an oblique direction oblique to both said front-to-back direction and said row direction, and a mounting tail at a rear end of the rear portion for mounting to a printed circuit board, lengths of said contacts being reduced with one another along said row direction so as to have said mounting tails arranged in a plane oblique to said front-to-back direction; wherein said connector defines a mounting face for mourning to said printed circuit board, and said rear portions of the contacts are essentially perpendicular to said mounting face under a condition that the mating face is essentially oblique to the mounting face rather than parallel thereto.

20. The electical connector as claimed in claim 19, wherein all mounting tails are same with one another each defining a plane perpendicular to that defined by the cozresponcling rear portion.

* * * * *